United States Patent [19]

Rhoades

[11] 4,240,279

[45] Dec. 23, 1980

[54] SHEET METAL BRAKE

[75] Inventor: James J. Rhoades, Garden City, Mich.

[73] Assignee: Tapco Products Company, Inc., Detroit, Mich.

[21] Appl. No.: 963,698

[22] Filed: Nov. 27, 1978

[51] Int. Cl.[3] ..... B21D 11/20

[52] U.S. Cl. ..... 72/319

[58] Field of Search ..... 72/319, 320, 321, 322

[56] References Cited

U.S. PATENT DOCUMENTS

| | | | |
|---|---|---|---|
| 3,147,791 | 9/1964 | Raven et al. | 72/319 |
| 3,559,444 | 2/1971 | Blazey et al. | 72/319 |
| 4,093,841 | 6/1978 | Chambers, Jr. | 72/320 |

*Primary Examiner*—Milton S. Mehr

*Attorney, Agent, or Firm*—Barnes, Kisselle, Raisch & Choate

[57] ABSTRACT

A brake for bending sheet metal comprising a pair of spaced base rails and a plurality of C-shaped members positioned on the base rails at longitudinally spaced points. Each C-shaped member comprises a lower arm fixed to the rails and an upper arm spaced from and overlying the lower arm. A first member is fixed on the lower arms of the C-shaped members and has a clamping surface. An anvil member is adapted to be locked on the first member to clamp a piece of sheet metal between the anvil member and the clamping surface of the first member. A second member having a bending surface is pivoted to the first member. The anvil member is generally L-shaped with a horizontal portion and a vertical portion. The vertical portion has longitudinally spaced notches therein through which the upper arm of each C-shaped member extends. The anvil member is resiliently mounted on the upper arms. An abutting portion is provided on the upper arm of each C-shaped member and is adapted to be contacted by the vertical portion of the anvil member and thereby minimize any tendency for rotation of the anvil member when the second bending member is swung to bend a piece of sheet metal or the like clamped between the anvil member and the clamping surface of the first member.

2 Claims, 4 Drawing Figures

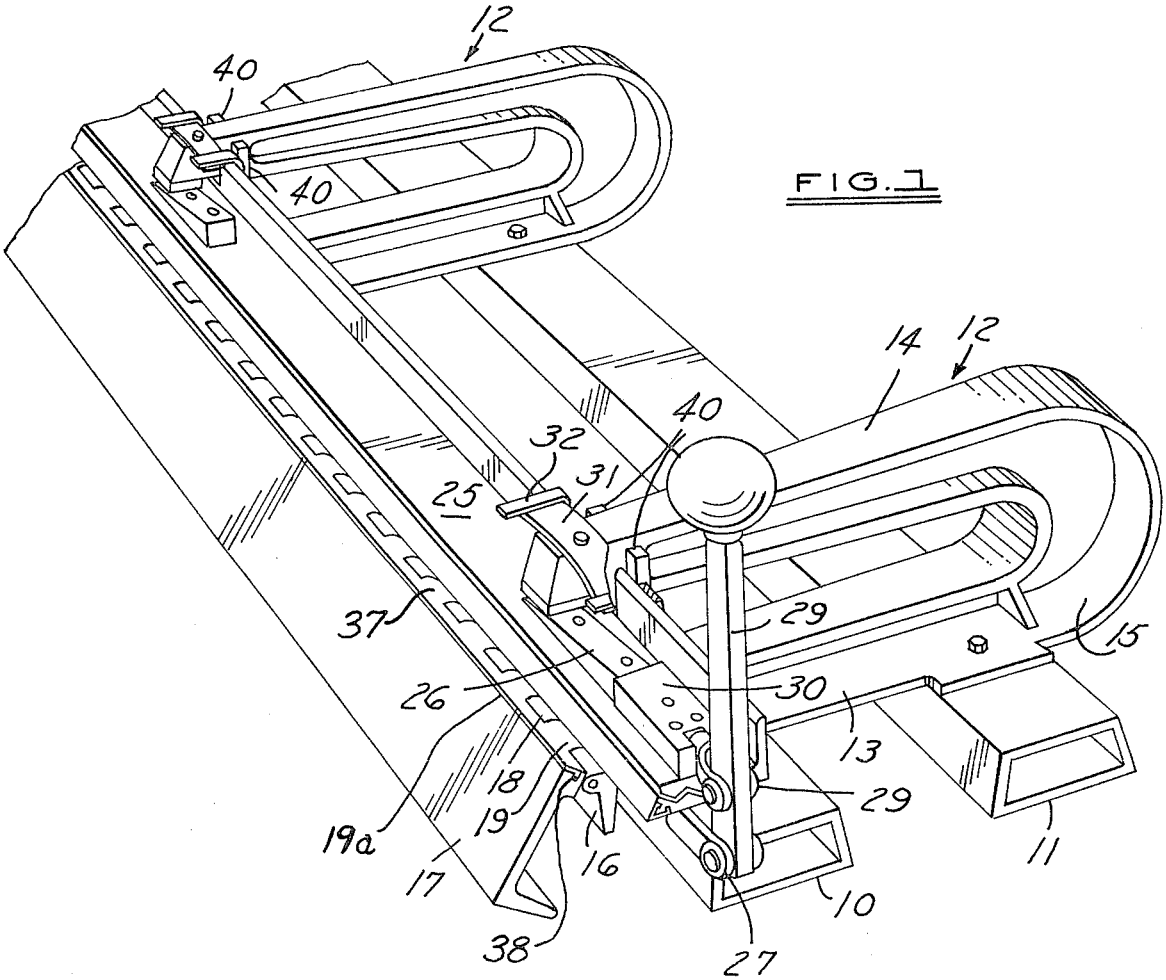
FIG. 1
FIG. 2
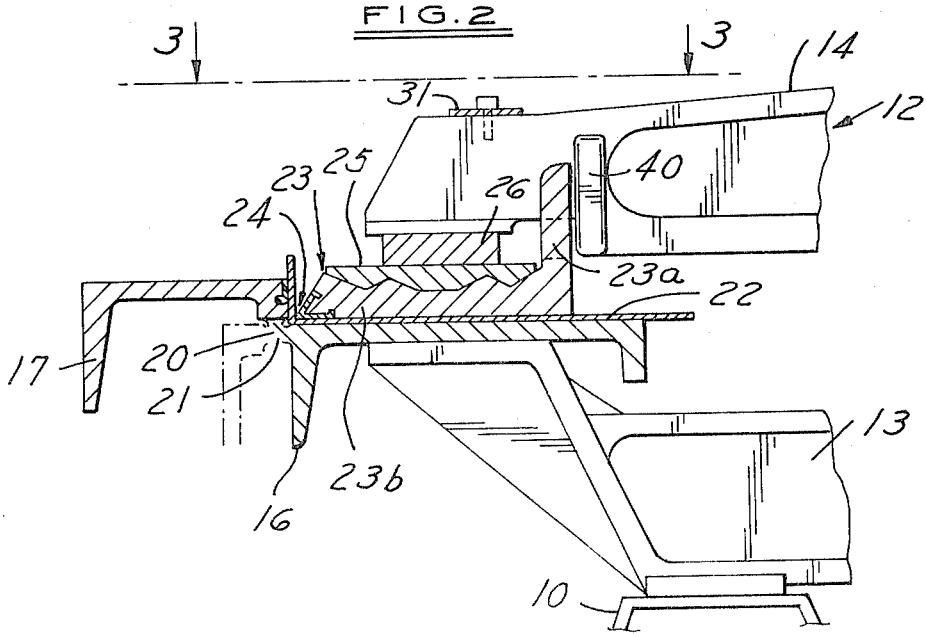

SHEET METAL BRAKE

This invention relates to sheet metal brakes.

BACKGROUND AND SUMMARY OF THE INVENTION

This invention relates to brakes for bending sheet material such as aluminum sheet and vinyl sheet that is utilized for application as siding for buildings and the like.

In the prior U.S. Pat. Nos. 3,161,223 and 3,559,444, there are disclosed and claimed sheet metal bending brakes wherein sheet metal is clamped between an anvil member, resiliently supported on the upper arms of C-shaped members, and a clamping surface and a bending member is hinged for bending the sheet metal about the anvil member.

A problem that arises in connection with bending relatively thick or stiff sheet material is the tendency for the anvil member, which is generally L-shaped to rotate when the bending member is swung to bend the material.

Accordingly, the invention is directed to a sheet metal brake wherein the tendency for such rotation and the resultant loss of accuracy of the bend is minimized.

In accordance with the invention, at least one laterally extending projection is provided on the C-shaped members adjacent each vertical portion of the L-shaped anvil member to engage the anvil member and thereby minimize any tendency for rotation so that the bend which is made is accurate and uniform throughout.

DESCRIPTION OF THE DRAWINGS

FIG. 1 is a fragmentary perspective view of a sheet metal brake embodying the invention.

FIG. 2 is a vertical sectional view through a portion of the brake shown in FIG. 1.

DESCRIPTION

Figure 3:
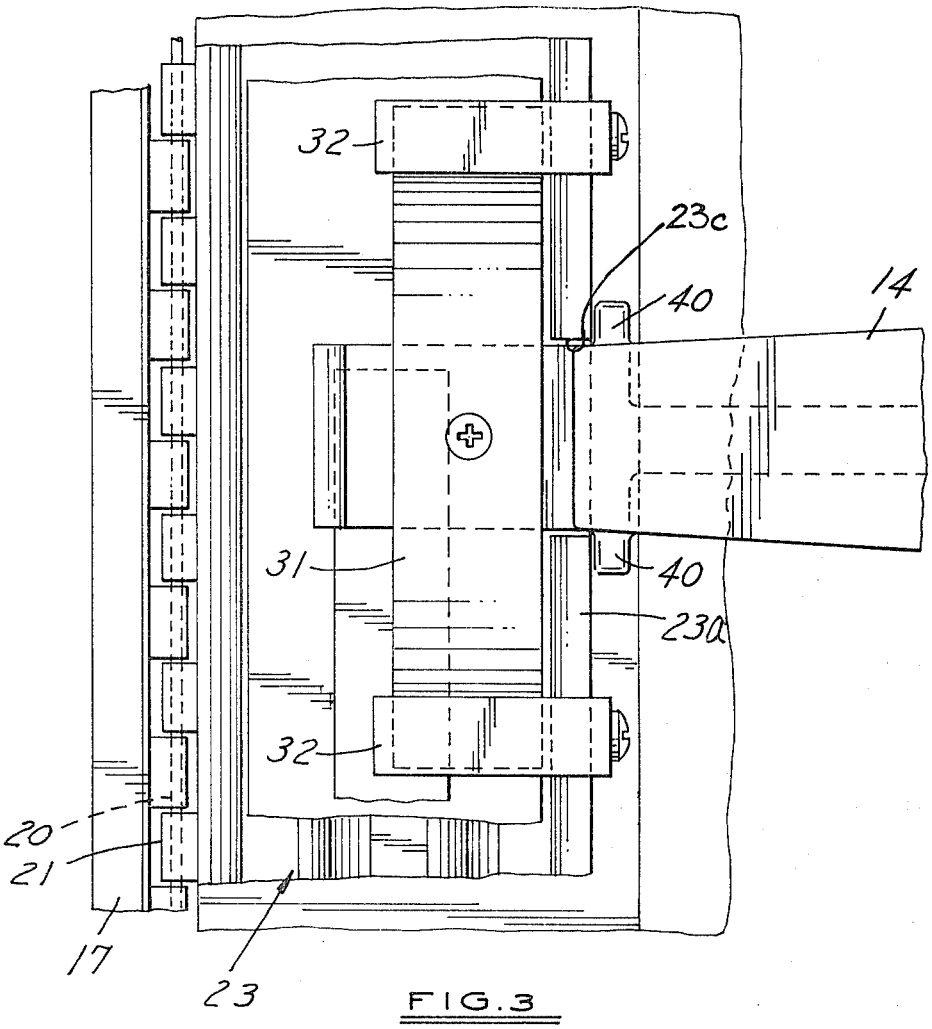
FIG. 3 is a fragmentary plan view taken along the line 3—3 in FIG. 2.

Referring to FIGS. 1 and 2, the sheet bending brake embodying the invention comprises a pair of spaced trapezoidal shaped tube members 10,11 formed of aluminum extrusions and longitudinally spaced C-shaped members 12 comprising aluminum castings bolted to the rails 10,11. Each C-shaped member 12 includes a lower arm 13, an upper arm 14 and an intermediate portion 15. The lower arms 13 are bolted to the rails 10,11.

A first member 16 in the form of an inverted channel is fixed on the lower leg 13 and a second channel 17 is hinged along one edge to the channel 16. Members 16,17 are formed with mating integral projections 18,19 along their adjacent longitudinal edges that are made by machining the edges along flat transverse planes. The projections are provided with aligned openings 20 and a hinge pin 21 is inserted in the openings to complete the hinge.

The upper surface 22 of member 16 provides a clamping surface and a generally L-shaped anvil member 23 is provided in overlying relation to the clamping surface 22 of the member 16. The anvil member 23 includes a sharp longitudinally extending edge 24 adjacent the hinge line. The anvil member includes notches **23*c* in the vertical portion thereof through which the upper arms 14** of the C-shaped members extend.

A pressure or backing plate 25 is provided in overlying relationship to the anvil member 23 and has inclined cams or wedges 26 fixed at longitudinally spaced points thereon in overlying relationship to the arms 14 of C-shaped members 12. The pressure member 25 is adapted to be moved longitudinally by an arrangement which includes a bracket 27 fixed on the member 16 at one end. An operating handle or lever 28 is pivoted at its lower end to the bracket 27 and intermediate its ends to a bracket 29 extending from a block 30 on the pressure member 25. By shifting the lever 28 inwardly or toward the left as viewed in FIG. 1, the pressure member 25 is moved to wedge the pressure member downwardly onto the anvil member 23 to clamp a piece of sheet material S between the anvil member 23 and the first member 16.

Spring plates 31 are fixed to each upper arm 14 and extend between brackets 32 fixed on the anvil member 23 to tend to elevate the anvil member 23 when the cams 26 are moved to the right as viewed in FIG. 1.

The anvil member 23 and pressure member 25 have cooperating generally V-shaped ribs 33,34 and valleys 35,36 which extend longitudinally between the edges thereof for guiding the movement of the pressure member relative to the anvil member.

As shown in FIG. 1, the ends of the anvil member 23 and pressure member 25 extend beyond the end of the first member 16 sufficiently so that when the pressure member 25 is moved to the right to relieve the pressure on the anvil member no portion of the end of the pressure member extends beyond the end of the anvil member. This insures that the pressure member will not become bent or damaged and will at all times remain straight insuring a uniform pressure on the sheet material.

When a piece of sheet material such as sheet metal or vinyl is to be bent, the lever 28 is swung to the right as viewed in FIG. 1 to relieve the clamping pressure and to elevate the anvil member 23. The sheet material is then inserted in proper position between the member 16 and anvil member 23 and the lever 28 is moved to the left as viewed in FIG. 1 to clamp the sheet metal. The member 17 is then swung upwardly through a handle, not shown, to bend the sheet material to the desired angle.

In order to prevent marring and scratching of the flat surface **19*a* of the bending member 17, an appropriate wear resistant surface may be provided, for example, by the well-known means of a vinyl strip 37 slidably received in a channel 38. The upper surface of the vinyl strip is flush with the surface 19*a***.

Figure 4:
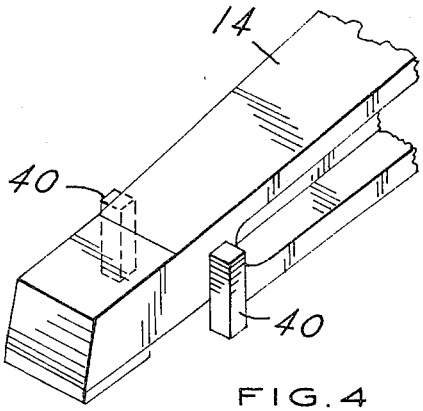
FIG. 4 is a fragmentary perspective view of a portion of the sheet metal brake.

As shown in FIGS. 1–4, laterally extending projections 40 are cast in situ in the upper arm 14 of the C-shaped member 12 and extend vertically from adjacent the upper end of the vertical portion **23*a* of the anvil member 23 for substantially the greater portion of the length thereof. When a piece of sheet metal or vinyl is positioned to be bent and number 17 is swung upwardly through an appropriate handle, any tendency for the anvil member 23 to rotate in a counterclockwise direction about its right edge (FIG. 2) at the area of juncture of the horizontal portion 23*b* and vertical portion 23*a* is minimized by engagement of the vertical portion 23*a* with the abutments 40** or projections shown. In this manner an accurate uniform bend is provided even though the material is relatively thick or stiff.

The laterally extending projections 40 are preferably formed integral but may be formed as separate pieces held in place and must at least contact the upper portion of the vertical portion of the anvil member in order to be most effective.

I claim:

1. A brake for bending sheet metal comprising a pair of spaced base rails, a plurality of C-shaped members positioned on said base rails at longitudinally space points, each said C-shaped member comprising a lower arm fixed to said rails and an upper arm spaced from and overlying said lower arm, a first member fixed on the lower arms of said C-shaped members and having a clamping surface, an anvil member including a horizontal portion and a vertical portion, said vertical portion of said anvil member having notches therein, means for clamping said anvil member on said first member to clamp a piece of sheet metal between said anvil member and said clamping surface of said first member, a second member having a bending surface, said anvil member having a longitudinal edge extending along said hinge line, means resiliently mounting said anvil member on said upper arms in a manner such that said upper arms extend through said notches in said vertical portion of said anvil member, and at least one abutting portion extending laterally on the upper arm of each said C-shaped member, said abutting portion extending vertically from adjacent the upper end of the vertical portion of said anvil member along the side of said notch for substantially the greater portion of the length of said vertical portion and adapted to be contacted by the anvil member and thereby minimize any tendency for rotation of the anvil member when the second bending member is swung to bend a piece of sheet metal or the like clamped between the anvil member and the clamping surface of said first member.

2. A brake for bending sheet metal comprising a pair of spaced base rails, a plurality of C-shaped members positioned on said base rails at longitudinally spaced points, each said C-shaped member comprising a lower arm fixed to said rails and an upper arm spaced from and overlying said lower arm, a first member fixed on the lower arms of said C-shaped members and having a clamping surface, an anvil member, means for clamping said anvil member on said first member to clamp a piece of sheet metal between said anvil member and said clamping surface of said first member, a second member having a bending surface, said anvil member having a longitudinal edge extending along said hinge line, said anvil member being generally L-shaped with a horizontal portion and a vertical portion, said vertical portion having longitudinally spaced notches therein through which the upper arm of each said C-shaped member extends, means resiliently mounting said anvil member on said upper arms in a manner such that said upper arms extend through said notches in said vertical portion of said anvil member, and abutting portions extending laterally on the upper arm of each said C-shaped member adjacent said notch, said abutting portions extending vertically from adjacent the upper end of the vertical portion of said anvil member along the sides of said notch for substantially the greater portion of the length of said vertical portion and adapted to be contacted by the vertical portion of the anvil member and thereby minimize any tendency for rotation of the anvil member when the second bending member is swung to bend a piece of sheet metal or the like clamped between the anvil member and the clamping surface of said first member.

* * * * *